US006413061B1

(12) United States Patent
Esumi et al.

(10) Patent No.: US 6,413,061 B1
(45) Date of Patent: Jul. 2, 2002

(54) ROTARY COMPRESSOR AND METHOD OF MANUFACTURING THE SAME

(75) Inventors: Mototaka Esumi; Kiyoharu Kyutoku, both of Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/713,152

(22) Filed: Nov. 15, 2000

(30) Foreign Application Priority Data

Nov. 15, 1999 (JP) ..... 11-323467
Jun. 1, 2000 (JP) ..... 2000-163851

(51) Int. Cl.[7] ..... F04C 18/356; B22F 7/02; C23C 8/26

(52) U.S. Cl. ..... 418/63; 418/178; 29/888.025; 148/220; 419/5

(58) Field of Search ..... 418/63, 178; 148/220; 419/5; 29/888.025

(56) References Cited

U.S. PATENT DOCUMENTS 5,165,870 A * 11/1992 Sato ..... 418/178
5,228,929 A * 7/1993 Panasiuk et al. ..... 148/220
5,263,834 A * 11/1993 Sato et al. ..... 418/178
6,139,296 A * 10/2000 Okajima et al. ..... 418/178

FOREIGN PATENT DOCUMENTS

JP 3-138479 * 6/1991 ..... 418/178

* cited by examiner

*Primary Examiner*—John J. Vrablik
(74) *Attorney, Agent, or Firm*—Ratner & Prestia

(57) ABSTRACT

A rotary compressor comprises a cylinder having an inner space and a groove, a roller sliding along the inside of the inner space of the cylinder, a vane penetrating through the groove, and refrigerant. The groove penetrates through the outside and inner space of the cylinder. The vane slides on the roller, and the vane also slides in and out of the groove. The vane includes stainless steel formed by sintering of powder material, a nitrogen diffusion layer disposed on the surface of the stainless steel, and a compound layer of iron and nitrogen disposed on the surface of the nitrogen diffusion layer. The stainless steel has a plurality of fine pores formed by sintering of powder material. The plurality of fine pores have a porosity of 15% or less.

55 Claims, 14 Drawing Sheets

ROTARY COMPRESSOR AND METHOD OF MANUFACTURING THE SAME

TECHNICAL FIELD OF THE INVENTION

The present invention relates to a rotary compressor, and more particularly to a rotary compressor suitable to a compressor using hydrofluorocarbon (HFC) refrigerant.

BACKGROUND OF THE INVENTION

A longitudinal sectional view and a lateral sectional view of a conventional rotary compressor are shown in FIG. 12 and FIG. 13. In FIG. 12 and FIG. 13, a motor unit 2 and a compressor unit 3 are disposed inside an enclosed container 1. A shaft 4 is directly coupled to the motor unit 2. The shaft 4 is supported by a main bearing 5 and a subsidiary bearing 6 provided above and beneath the compressor unit 3. A cylinder 37 is provided concentrically with the shaft 4. In the compressor unit 3, a suction hole 8 is formed in the side of the cylinder 37, and a discharge notch 9 is formed in the upper part of the cylinder 37. One end of a suction pipe 10 is connected to the suction hole 8. A discharge port 11 is formed in the upper part of the enclosed container 1. One end of a discharge pipe 12 is connected to the discharge port 11. Other end of the suction pipe 10 and other end of the discharge pipe 12 are connected to an accumulator (not shown). As lubricating oil, refrigerating machine oil 27 is added to the refrigerant. The refrigerating machine oil is liquefied in the enclosed container 1.

In this structure, the refrigerant circulates inside and outside of the enclosed container 1.

A roller 33 is installed in the cylinder 37, eccentrically to the shaft 4. The roller 33 makes a planetary movement along with rotation of the shaft 4. Between the suction hole 8 and the discharge notch 9 in the cylinder 37, a guide groove 34 is formed in the radial direction of the cylinder. A flat vane 35 is inserted in this guide groove 34. By thrusting force and back pressure (discharge pressure) of a spring 16, the vane 35 is pressed against the roller 33 at the axial center side of the cylinder 37. Thus, the space in the cylinder 37 is partitioned into a suction chamber 17 and a compression chamber 18.

In this structure, the roller 33 makes a planetary movement along the inner wall inside of the cylinder 37. As a result, the vane 35 pressed against the outer wall of the roller 33 moves in and out in the radial direction of the cylinder 37 inside the guide groove 34. In the suction chamber 17 partitioned by the vane 35, gas is sucked in through the suction port 8. The sucked gas is compressed in the compression chamber 18, and this gas is discharged into a specified space through the discharge notch.

Generally, the manufacturing method of the vane 35 comprises a step of heating a special ferrous fusible material having an excellent wear resistance, a step of grinding after heating, and a step of nitriding for forming a nitrogen diffusion layer and a compound layer. In this case, the compound layer at the leading end of the vane 35 is left over, and the vane side rubbing against the cylinder 37 is ground and finished precisely to enhance the dimensional precision.

However, since the nitrogen diffusion layer of the vane side exposed by precision finishing is a single layer, the conventional vane 35 cannot hold the refrigerating machine oil. As a result, the cylinder 37 and vane 35 are slightly inferior in wear resistance. In addition, since the vane 35 is made of special ferrous fusible material, entire surface processing is needed. Hence, the manufacturing cost is very high.

Recently, on the other hand, the sliding conditions are very severe in the cylinder 37, roller 33, and vane 35. Still more, when R22 (monochlorodifluoromethane) substitute refrigerant is used as the refrigerant, combination with a material having a higher wear resistance is required. That is, as in the conventional vane 35, the wear resistance is insufficient in the vane 35 made of a single material such as special steel, special casting, or ferrous sintering material. Further, if the vane 35 made of such special ferrous fusible material is processed by finishing or nitriding, sufficient wear resistance is not obtained in the cylinder 7 or vane 35.

It is hence a primary object of the invention to present a rotary compressor having an excellent wear resistance and low cost.

SUMMARY OF THE INVENTION

A rotary compressor of the invention comprises:

(a) a cylinder having an inner space and a groove, (b) a roller sliding along the inner surface of the inner space of the cylinder, (c) a vane inserted in the groove, and (d) a refrigerant.

In which the groove penetrates through the outside of the cylinder and the inner space, and the vane slides in and out in the groove while sliding on the roller.

The vane includes sintered stainless, nitrogen diffusion layer disposed on the surface of the sintered stainless steel, and a compound layer of iron and nitrogen disposed on the surface of the nitrogen diffusion layer.

The sintered stainless steel has a plurality of fine pores formed by sintering of the powder material, and the plurality of fine pores have a porosity of 15% or less.

Preferably, the vane includes stainless steel of martensitic structure, a nitrogen diffusion layer disposed on the surface of the stainless steel, and a compound layer of iron and nitrogen disposed on the surface of the nitrogen diffusion layer, and more specifically, the stainless steel has one chemical composition of either (i) a chemical composition of iron, 9 to 27% of chromium, and 0.4% or more of carbon, or (ii) a chemical composition-of iron, 9 to 27% of chromium, 4 to 8% of nickel, and 0.2% or less of carbon.

The stainless steel has a plurality of fine pores formed by sintering of powder material having a hardening property, and the plurality of fine pores have a porosity of 15% or less.

A manufacturing method of rotary compressor of the invention comprises:

(a) a step of Preparing a cylinder, (b) a step of preparing a roller, (c) a step of preparing a vane, (d) a step of presenting a refrigerant, and (e) a step of assembling the cylinder, roller, vane, and refrigerant.

The step of preparing the vane further comprises:

(i) a step of molding a stainless steel powder material into a specified shape, land forming a molded piece, (ii) a step of baking the molded piece and forming a base molded piece having fine pores, in which the fine pores have a porosity of 15% or less, (iii) a step of heating the base molded piece, and forming a base molded piece having martensitic structure, and (iv) a step of nitriding the base molded piece having the martensitic structure and fine pores, and placing a nitrogen diffusion layer and an iron-nitrogen compound layer on the surface of the base:molded piece. In which, the nitrogen diffusion layer is formed on the base molded piece, and the compound layer is formed on the nitrogen diffusion layer.

In this structure, the wear resistance of the vane is extremely improved. Further, the dimensional distortion of the vane is decreased. In addition, strength lowering and brittleness of the vane are lessened. As a result, the long-term reliability of the rotary compressor is extremely enhanced.

REFERENCE NUMERALS

Figure 1:
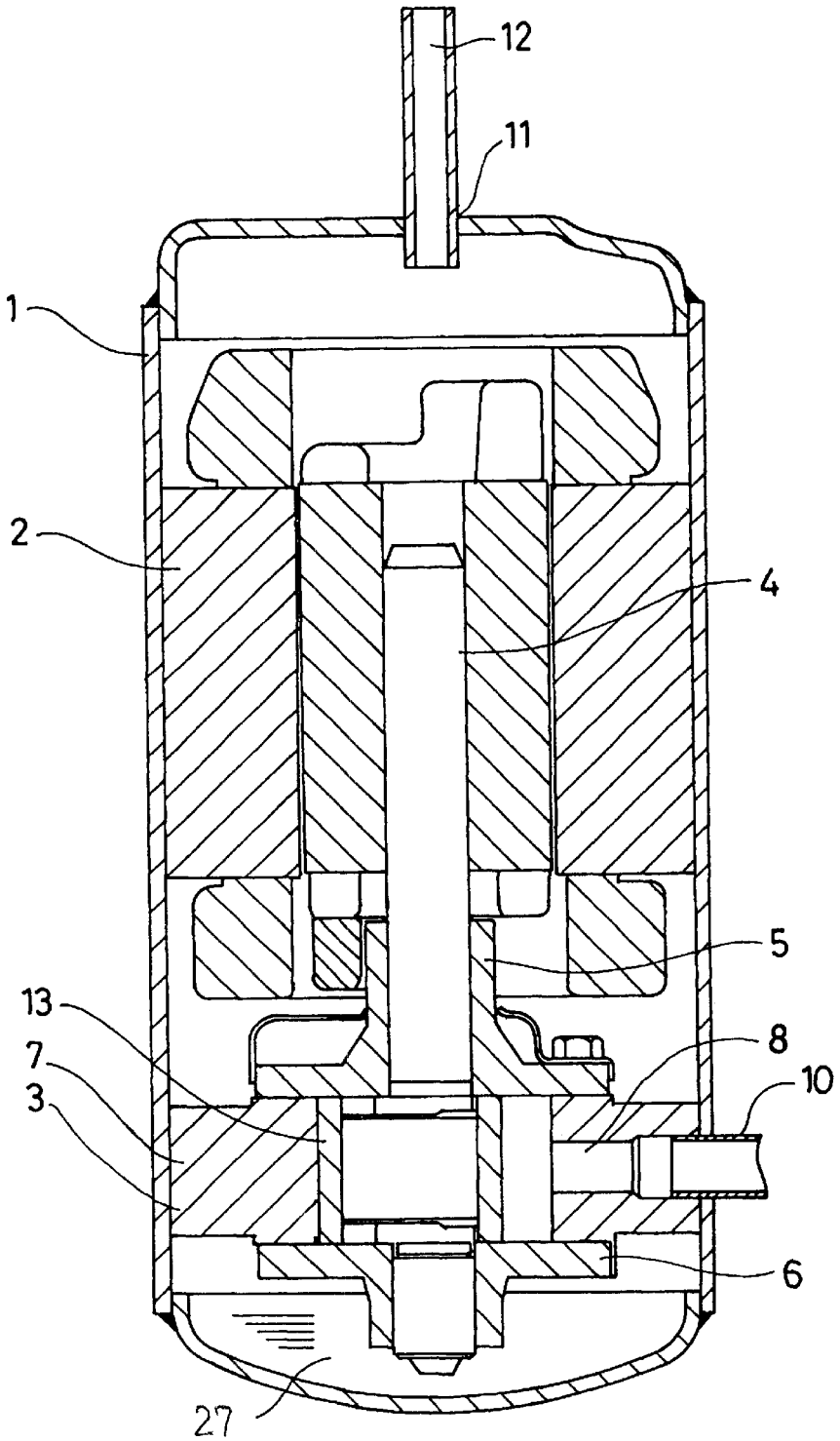
FIG. 1 is a longitudinal sectional view showing a schematic entire structure of a rotary compressor in an embodiment of the invention.

7 Cylinder
8 Suction hole
9 Discharge notch
13 Roller
14 Guide groove
15 Vane
15*a* Vane leading end
15*b* Vane side surface
19 Fine pore
20 Compound layer (Fe—N layer)
21 Nitrogen diffusion layer
22 Compound layer in pore
23 Oxide film

DETAILED DESCRIPTION OF THE INVENTION

A rotary compressor in an embodiment of the invention comprises:

(a) a cylinder having an inner space and a groove, (b) a roller sliding along the inner surface of the inner space of the cylinder, (c) a vane inserted in the groove, and (d) a refrigerant.

In which the groove penetrates through the outside of the cylinder and the inner space, and the vane slides in and out in the groove while sliding on the roller.

The vane includes stainless steel formed by sintering of powder material, nitrogen diffusion layer disposed on the surface of the stainless steel, and a compound layer of iron and nitrogen disposed on the surface of the nitrogen diffusion layer.

The stainless steel has a plurality of fine pores formed by sintering of the powder material, and the plurality of fine pores have a porosity of 15% or less.

Preferably, the vane includes stainless steel of martensitic structure, a nitrogen diffusion layer disposed on the surface of the stainless steel, and a compound layer of iron and nitrogen disposed on the surface of the nitrogen diffusion layer, and more specifically.

The stainless steel has one chemical composition of either (i) a chemical composition of iron, 9 to 27% of chromium, and 0.4% or more of,carbon, or (ii) a chemical composition of iron, 9 to 27% of chromium, 4 to 8% of nickel, and 0.2% or less of carbon.

The stainless steel has a plurality of fine pores formed by sintering of powder material having a hardening property, and the plurality of fine pores have a porosity of 15% or less.

In this structure, the wear resistance of the vane is extremely improved. Further, the dimensional distortion of the vane is decreased. In addition, strength lowering and brittleness of the vane are lessened. As a result, the long-term reliability of the rotary compressor is extremely enhanced.

A manufacturing method of rotary compressor of the invention comprises:

(a) a step of preparing a cylinder, (b) a step of preparing a roller, (c) a step of preparing a vane, (d) a step of presenting a refrigerant, and (e) a step of assembling the cylinder, roller, vane, and refrigerant.

The step of preparing the vane further comprises:

(i) a step of molding a stainless steel powder material into a specified shape, and forming a molded piece, (ii) a step of baking the molded piece and forming a base molded piece having fine pores, (iii) a step of heating the base molded piece, and forming a base molded piece having martensitic structure, and (iv) a step of nitriding the base molded piece having the martensitic structure and fine pores, and placing a nitrogen diffusion layer and an iron-nitrogen compound layer on the surface of the base molded piece.

Herein, the fine pores have a porosity of 15% or less, and the nitrogen diffusion layer is formed on the base molded piece, and the compound layer is formed on the nitrogen diffusion layer.

Preferably, the cylinder has an inner space and a groove, the groove penetrates through the outside of the cylinder and the inner space, the roller slides along the inside of the inner space of the cylinder, the vane is inserted in the groove as penetrating through the groove, and the vane slides in and out in the groove.

Preferably, the cylinder is nearly cylindrical, the groove is formed in the radial direction of the cylinder, the inner space of the cylinder has a circular cross section, the space has a suction part and a discharge part, the outer circumference of the roller has a circular cross section, the outer circumference of the roller rotates in the inner space while sliding on the inner circumference of the inner space, the vane slides in and out in the groove while the leading end of the vane slides on the outer circumference of the vane, and the vane partitions the inner space of the cylinder into the suction part and discharge part.

In this structure, since the vane is fabricated by using sintered iron, the vane can be manufactured by grinding process alone. Therefore, the manufacturing process is substantially simplified, and the management of manufacturing process is saved. As a result, the manufacturing cost is lowered. Further, the vane strength, dimensional precision and mass producibility are extremely enhanced.

A rotary compressor in an embodiment of the invention comprises a cylinder having a refrigerant suction port and a discharge port, a roller rolling along the inner circumference of the cylinder, and a vane. The vane has a groove formed in the radial direction in the cylinder. The vane is inserted into the groove, and moves in and out in a state of sliding on the outer circumference of the roller, and partitions the inside of the cylinder into the suction part side and discharge part side. The vane is made of ferrous powder having quenching hardenability. The ferrous powder having quenching hardenability comprises iron (Fe), 9 to 27% of chromium (Cr), and 0.4% or more of carbon (C). The ferrous powder having quenching hardenability is molded and sintered, and sintered iron is prepared as the base molded piece for the vane. The sintered iron has a porosity of 15% or less. This base molded piece of sintered iron is quenched and tempered, and the base molded piece of sintered iron becomes a martensitic structure. The surface of the martensitic sintered iron is nitrided, and a nitrogen diffusion layer is formed on the surface of the base molded piece, and a compound layer of iron and nitrogen (Fe—N layer) is formed on the nitrogen diffusion layer. Thus, the vane is formed. The nitriding process herein means ordinary nitriding or soft nitriding.

The nitrogen diffusion layer is a layer in the base molded piece in which nitrogen is diffused. The compound layer is a layer having a compound of iron and nitrogen.

Preferably, the ferrous powder material is any one of SUS440A, SUS440B, SUS440C, SKD1, and SKD11.

In this composition, when the vane contains Cr by 9% or more, the wear resistance of the Fe—N layer is improved, and the wear resistance of the nitrogen diffusion layer is improved outstandingly. When the content of Cr exceeds 27%, or when the Cr content is less than 0.4%, the martensitic structure of the vane is insufficient. Besides, since the vane porosity is 15% or less, deep permeation of nitrogen gas into the vane is prevented in the nitriding process. As a result, the dimensional distortion is small, decline of strength by nitriding is lessened, and brittleness is decreased.

The rotary compressor in other embodiment of the invention comprises a cylinder having a refrigerant suction port and a discharge port, a roller rolling along the inner circumference of the cylinder, and a vane. The vane has a groove formed in the radial direction in the cylinder. The vane is inserted into the groove, and moves in and out in a state of sliding on the outer circumference of the roller, and partitions the inside of the cylinder into the suction part side and discharge part side. The vane is made of ferrous powder having quenching precipitation hardenability. The ferrous powder having quenching precipitation hardenability comprises iron (Fe), 9 to 27% of chromium (Cr), 4 to 8% of nickel (Ni), and 0.2% or more of carbon (C). The ferrous powder having quenching precipitation hardenability is molded and sintered, and sintered iron is prepared as the base for the vane. The sintered iron has a porosity of 15% or less. This base material of sintered iron is heated, and the base material of sintered iron becomes a martensitic structure. The surface of the martensitic sintered iron is nitrided, and an Fe—N layer and a nitrogen diffusion layer are formed on the surface layer of the sintered iron sequentially. Thus, the vane is formed. The nitriding process herein means ordinary nitriding or soft nitriding.

Preferably, the ferrous powder material is either SUS630 or SUS631.

In this composition, when the vane contains Cr by 9% or more, the wear resistance of the Fe—N layer is improved, and the wear resistance of the nitrogen diffusion layer is improved outstandingly. When the content of Cr exceeds 27%, or when the Cr content is less than 0.4%, the martensitic structure of the vane is insufficient. besides, since the vane porosity is 15% or less, deep permeation of nitrogen gas into the vane is prevented in the nitriding process. As a result, the dimensional distortion is small, decline of strength by nitriding is lessened and brittleness is decreased.

Preferably, the sintered iron is formed by solid phase sintering or liquid phase sintering. To control the porosity of the sintered iron below 15%, usually, a material by liquid phase sintering is used, but not limited to this, solid phase sintering is also possible by using additives or adjusting the sintering conditions.

Preferably, the side surface of the vane sliding in the groove of the cylinder has a nitrogen diffusion layer exposed by grinding, and this nitrogen diffusion layer is a principal sliding surface. In this composition, the compound layer is also formed in the pores of the nitrogen diffusion layer, and the refrigerating machine oil is securely held by the compound layer formed inside. As a result, agglutination wear of vane and cylinder is prevented, and a vane sliding surface of an excellent wear resistance is obtained.

Preferably, the side surface of the vane sliding in the groove of the cylinder has a mixed structure of nitrogen diffusion layer and Fe—N layer exposed by grinding, and this mixed structure is the sliding surface. In this composition, a gap is formed by sliding wear between the Fe—N compound layer and nitrogen diffusion layer. The refrigerating machine oil is held in this gap. As a result, agglutination wear of vane and cylinder is prevented, and a vane sliding surface of an excellent wear resistance is obtained.

Preferably, the, side surface of the vane sliding in the groove of the cylinder has an Fe—N compound layer exposed by grinding, and this Fe—N compound layer is the sliding surface. In this composition, since the Fe—N compound layer is a structure hardly inducing metal agglutination, and agglutination wear of vane and cylinder is prevented, and a vane sliding surface of an excellent wear resistance is obtained.

Preferably, the leading end of the vane sliding on the roller has an Fe—N compound layer, and this Fe—N compound layer is the sliding surface. In this composition, if the vane contains Cr by more than 9%, a vane having an excellent wear resistance is obtained by the effect of the chromium nitride contained in the Fe—N compound layer.

Preferably, the leading end of the vane sliding on the roller has an Fe—N layer of surface roughness of Ry 3 $\mu$m or less exposed by grinding, and this Fe—N layer is the sliding surface. In this composition, since the Fe—N layer of surface roughness Ry of 3 $\mu$m slides oh the roller, large stress hardly acts on fine bumps and metal agglutination is efficiently prevented, and therefore agglutination wear of vane and cylinder is prevented, and a vane sliding surface of an excellent wear resistance is obtained.

Preferably, the nitriding process is gas nitriding or gas soft nitriding process. In this composition, the Fe—N layer and nitrogen diffusion layer are formed favorably.

Preferably, the nitrogen diffusion layer is formed at nitriding temperature ranging from 500 to 580° C., and the nitrogen diffusion layer has a thickness of 0.05 mm or more. In this composition the Fe—N compound layer and nitrogen diffusion layer having an excellent wear resistance and specified thickness are obtained. After grinding, the nitrogen diffusion layer having an excellent wear resistance is assured.

Preferably, an oxide film is formed on the surface of the porous sintered iron by steam treatment. In this composition, even the base molded piece containing much Cr which is hard to nitride can be easily nitrided by the presence of iron oxide film (tri-iron tetra-oxide film).

Preferably, the roller is made of cast iron comprising iron (Fe), 0.5 to 1.0% of chromium (Cr), 0.2 to 0.4% of molybdenum (Mo), and 0.1 to 0.4% of phosphorus (P). In this composition, a roller having an excellent wear resistance is obtained.

Preferably, the roller is made of cast iron comprising iron (Fe), 0.5 to 1.0% of chromium (Cr), 0.2 to 0.4% of molybdenum (Mo), and 0.02 to 0.1% of boron (B). In this composition, a roller having an excellent wear resistance is obtained.

Preferably, the refrigerant is hydrofluorocarbon (HFC), and the refrigerating machine oil contains ester oil. In this composition, if HFC is used as substitute CFC refrigerant, a rotary compressor of high reliability is obtained.

Preferably, the refrigerant contains difluoromethane (R32).

In the foregoing: description, the Fe—N layer means a layer forming a nitride such as $Fe_2N$, $Fe_{2-3}N$, and $Fe_3N$. The nitrogen diffusion layer is a diffusion layer containing an over saturated solid solution having N solidified in Fe, or a hard nitride of alloy element.

The chemical composition of stainless steel is expressed in the unit of wt. %

Referring now to the drawings, exemplary embodiments of the invention are described below.

Exemplary Embodiment 1

Figure 2:
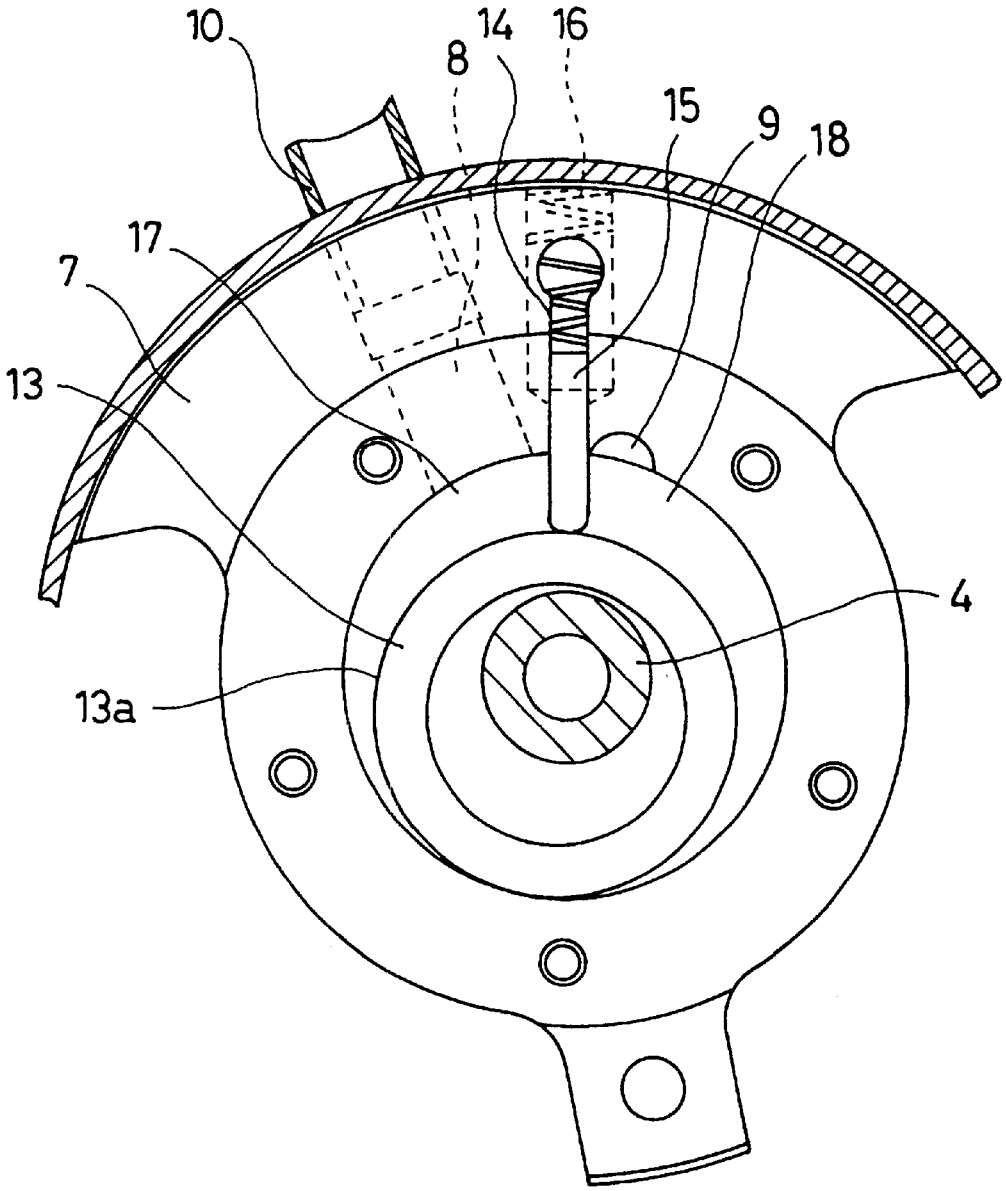
FIG. 2 is a sectional view of side surface of vane for composing the rotary compressor in an embodiment of the invention.

A rotary compressor in exemplary embodiment 1 of the invention is shown in FIG. 1 and FIG. 2.

In FIG. 1 and FIG. 2, a motor unit 2 and a compressor unit 3 are disposed inside an enclosed container 1. A shaft 4 is directly coupled to the motor unit 2. The shaft 4 is supported by a main bearing 5 sand a subsidiary bearing 6 provided above and beneath the compressor unit 3. A cylinder 7 is provided concentrically with the shaft 4. In the compressor unit 3, a suction hole 8 is formed in the side of the cylinder 7, and a discharge notch 9 is formed in the upper part of the cylinder 7. One end of a suction pipe 10 is connected to the suction hole 8. A discharge port 11 is formed in the upper part of the enclosed container 1. One end of a discharge pipe 12 is connected to the discharge port 11. Other end of the suction pipe 10 and other end of the discharge pipe 12 are connected to an accumulator (not shown). As lubricating oil, refrigerating machine oil 27 is added to the refrigerant. The refrigerating machine oil is liquefied in the enclosed container 1.

In this structure, the refrigerant circulates inside and outside of the enclosed container 1.

A roller 13 is installed in the cylinder 7, eccentrically to the shaft 4. The roller 13 makes a planetary movement along with rotation of the shaft 4. Between the suction hole 8 and the discharge notch 9 in the cylinder 7, a guide groove 14 is formed as a groove in the radial direction of the cylinder. A flat vane 15 is inserted in this guide groove 14. By thrusting force and back pressure (discharge pressure) of a spring 16, the vane 15 is pressed against the roller 13 at the axial center side of the cylinder. Thus, the space in the cylinder 7 is partitioned into a suction chamber 17 and a compression chamber 18.

In this structure, the roller 13 makes a planetary movement along the inner wall inside of the cylinder 7. As a result, the vane 15 pressed against the outer wall of the roller 13 moves in and out in the radial direction of the cylinder 7 inside the guide groove 14. In the suction chamber 17 partitioned by the vane 15, gas is sucked in through the suction port 8. The sucked gas is compressed in the compression chamber 18, and this gas is discharged into a specified space through the discharge notch.

Figure 11:
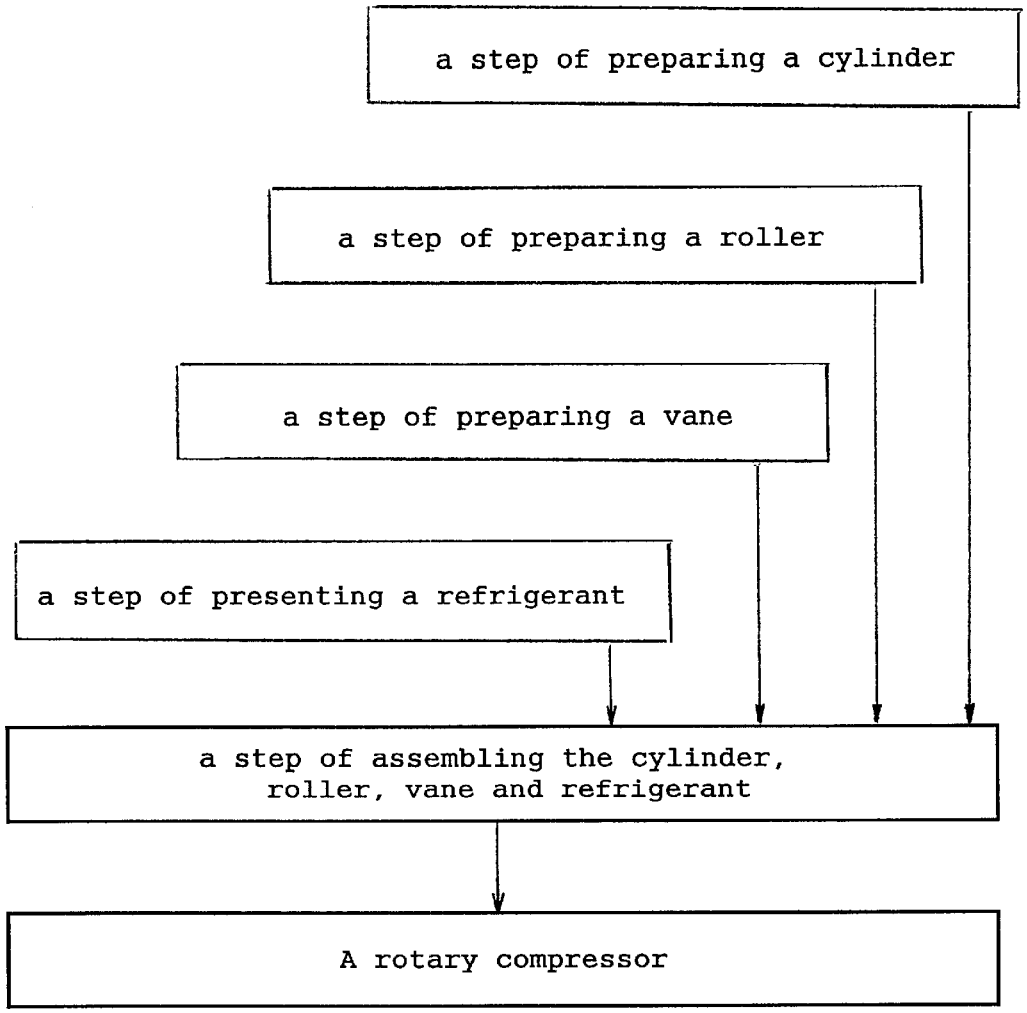
FIG. 11(*a*) and FIG. 11(*b*) shows the manufacturing process of the rotary compressor in an embodiment of the invention.
Figure 11:
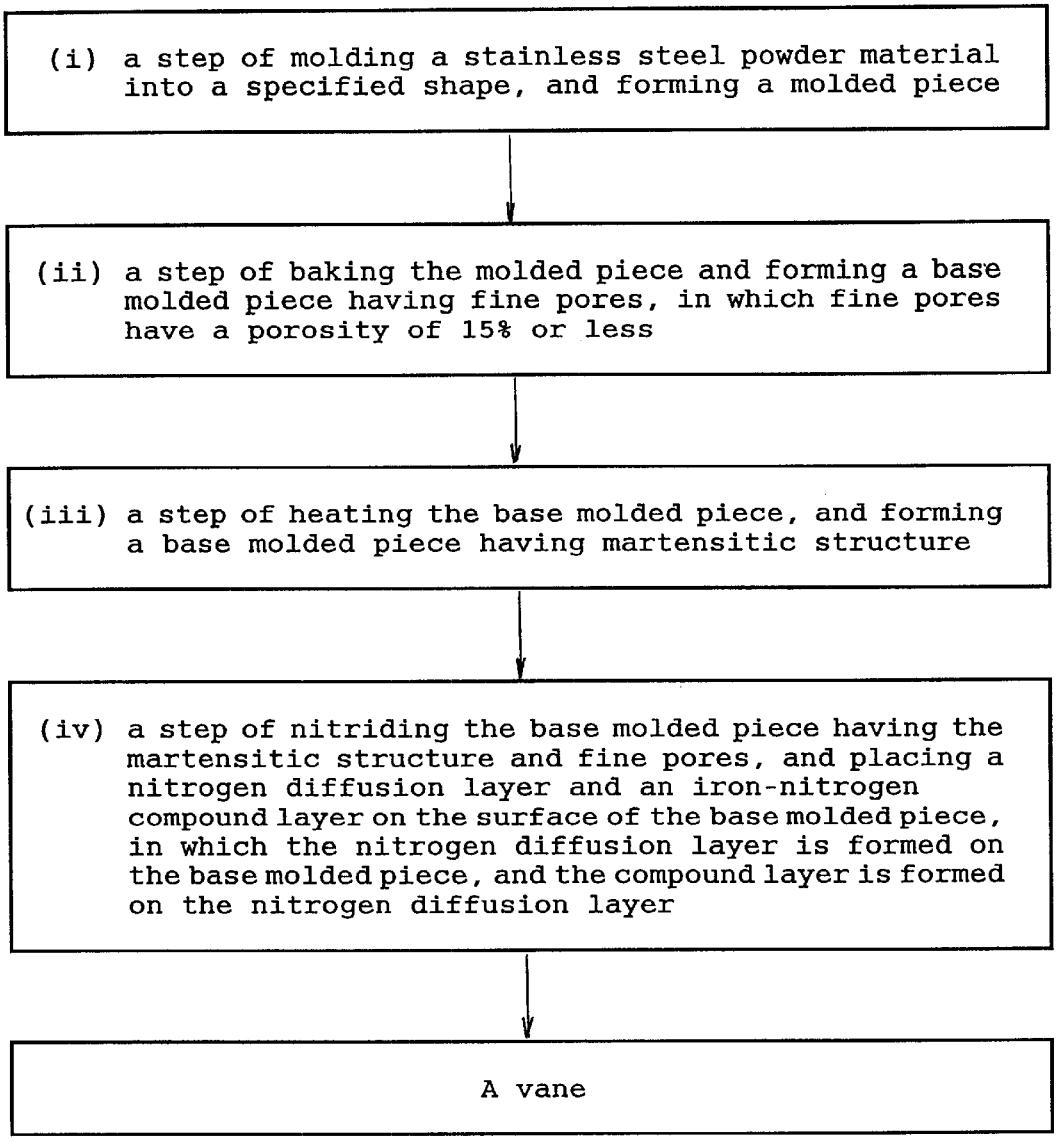
Figure 12:
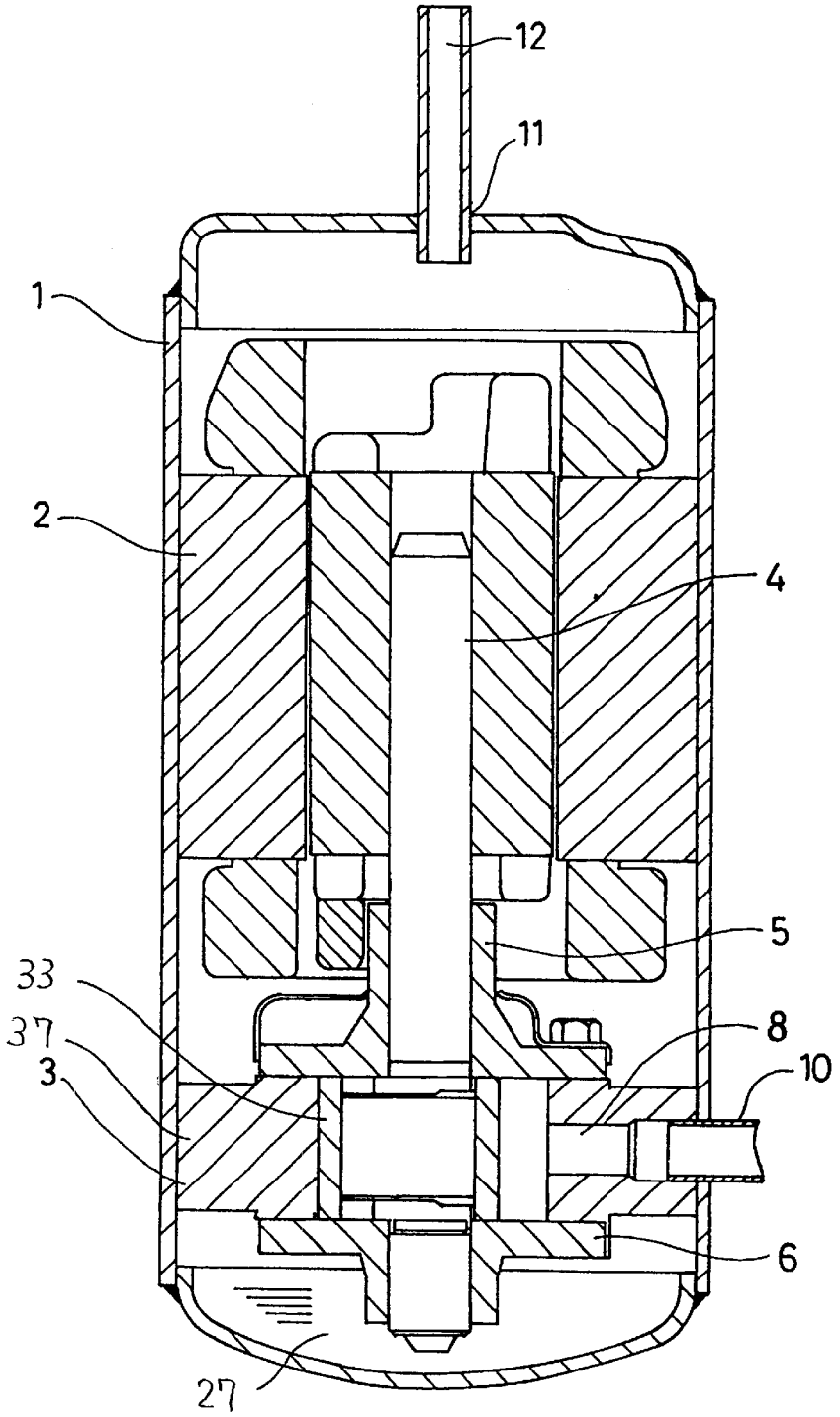
Fig. 12 PRIOR ART
FIG. 12 is a longitudinal sectional view showing a schematic entire structure of a conventional rotary compressor.
Figure 13:
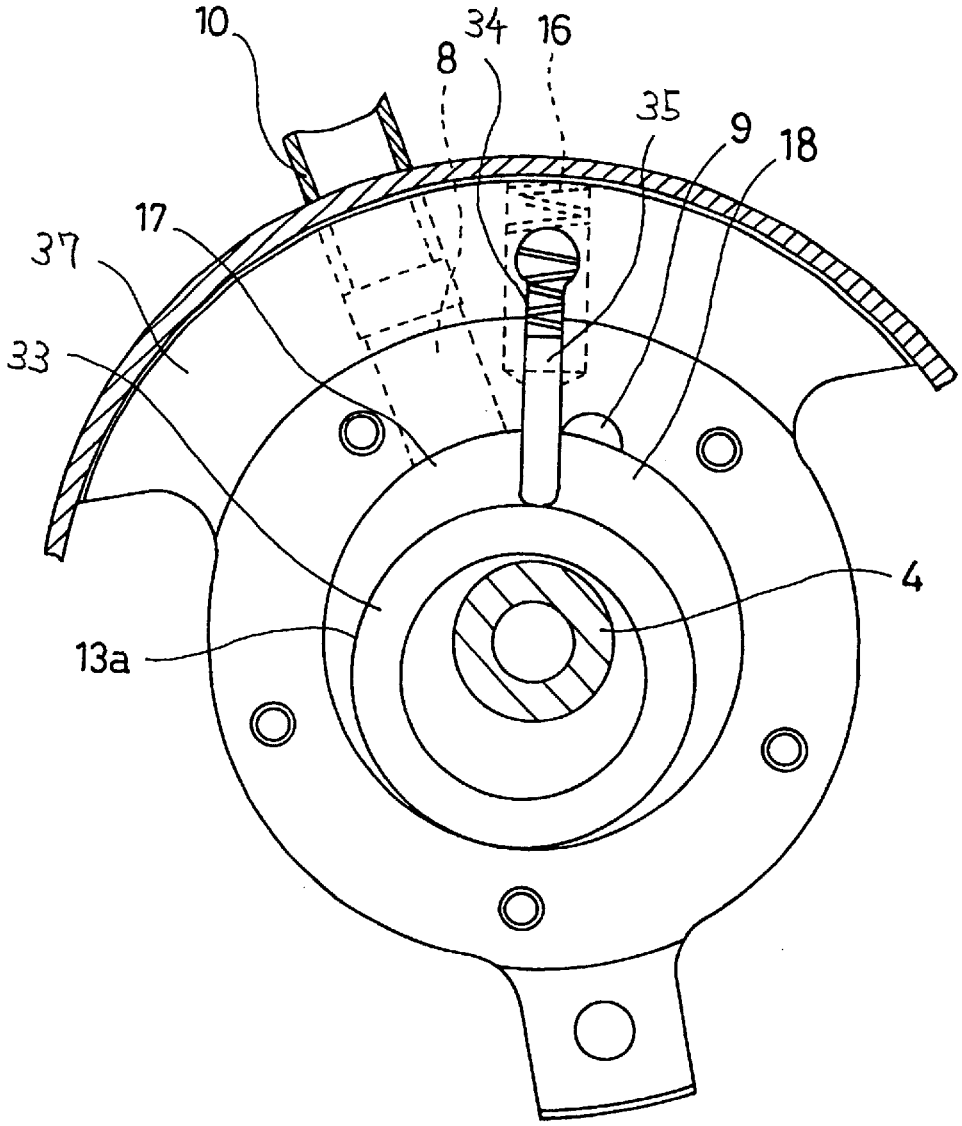
Fig. 13 PRIOR ART
FIG. 13 is a lateral sectional view of the conventional rotary compressor.

A manufacturing method of the rotary compressor in an embodiment of the invention is schematically shown in FIG. 11(*a*) and FIG. 11(*b*).

In FIG. 11, the manufacturing method of the rotary compressor comprises:

(a) a step of preparing a cylinder, (b) a step of preparing a roller, (c) a step of preparing a vane, (d) a step of presenting a refrigerant, and (e) a step of assembling the cylinder, roller, vane, and refrigerant.

The step of preparing the vane further comprises:

(i) a step of molding a stainless steel powder material into a specified shape, and forming a molded piece, (ii) a step of baking the molded piece and forming a base molded piece having fine pores, in which the fine pores have a porosity of 15% or less, (iii) a step of heating the base molded piece, and forming a base molded piece having martensitic structure, and (iv) a step of nitriding the base molded piece having the martensitic structure and fine pores, and placing a nitrogen diffusion layer and an iron-nitrogen compound layer on the surface of the base molded piece, in which the nitrogen diffusion layer is formed on the base molded piece, and the compound layer is formed on the nitrogen diffusion layer.

What the rotary compressor in this exemplary embodiment differs from the conventional rotary compressor lies in the cylinder 7 containing the guide groove 14, roller 13, and vane 15. That is, the cylinder 7 is made of die eutectic graphite cast iron containing 10 to 50% of pearlite. The roller 13 is made of alloy cast iron containing iron, 0.8% of chromium (Cr), 0.2% of nickel (Ni), 0.2% of molybdenum (Mo), and 0.2% of phosphorus (P). This alloy cast iron is quenched and tempered.

Figure 3:
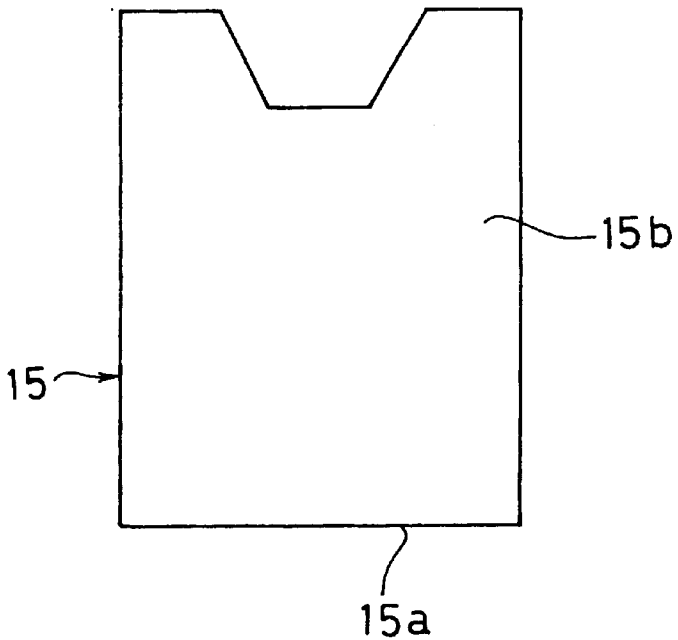
FIG. 3(*a*) shows:a top view of vane for composing the rotary compressor in an embodiment of the invention, and FIG. 3(*b*) shows a side view.
Figure 3:
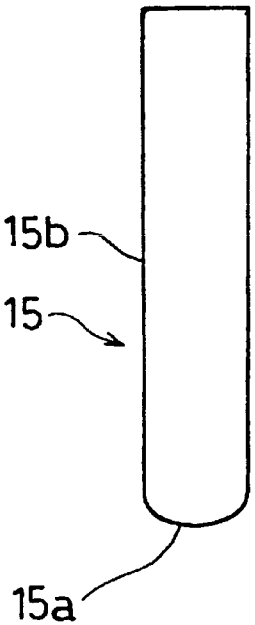

The vane 15 has a structure as shown in FIG. 3(*a*) showing a top view and FIG. 3(*b*) showing a side view. The vane 15 has a plurality of pores formed on the entire surface, and the porosity is 15% or less. The vane 15 has a leading end 15*a* and a side surface 15*b*, and the leading end 15*a* and side surface 15*b* have layers formed as described below.

First, a molded piece was prepared by using martensitic stainless steel powder having quenching hardenability, comprising 16.0 to 18.0% of chromium (Cr) and 0.95 to 1.2% of carbon (C). This molded piece was sintered in solid phase. Thus, a base molded piece 15*e* having a porosity of 15% or less was formed. This base molded piece 15*e* was quenched and tempered, and the base molded piece 15*e* having a martensitic structure was obtained. This base molded piece 15*e* was ground, and the leading end 15*a* and side surface 15*b* were finished. The martensitic structure is a kind of quenched steel structure, and is a solid solution solidifying carbon. The microstructure of the martensitic structure is an acicular profile.

Figure 4:
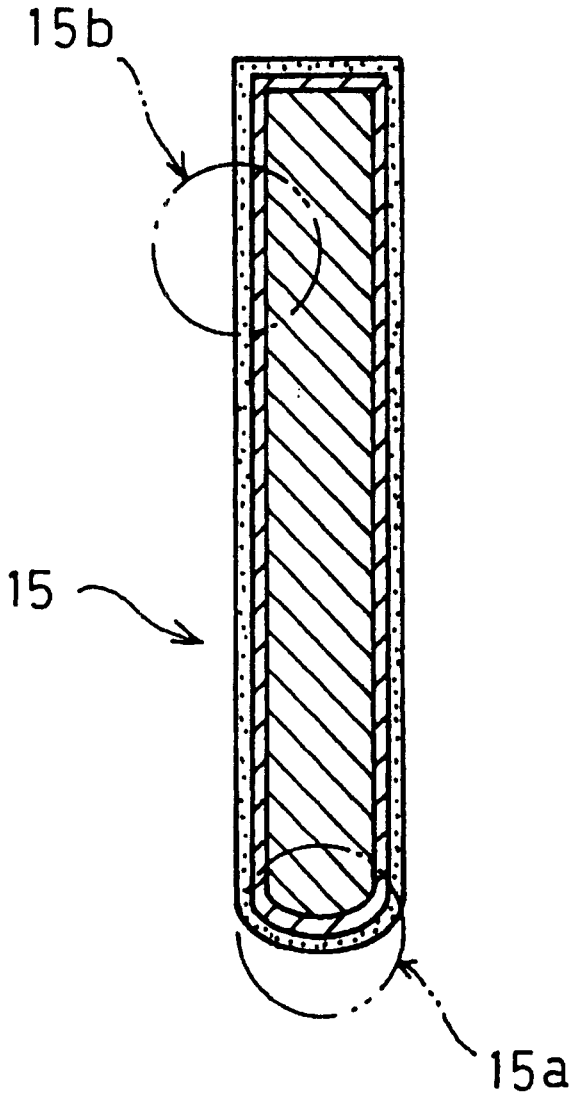
FIG. 4 is a sectional view in the mist of manufacture of the vane shown in FIG. 3.
Figure 5:
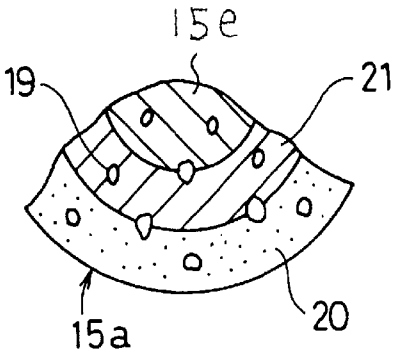
FIG. 5(*a*), FIG. 5(*b*), and FIG. 5(*c*) are sectional views during and after manufacture of the leading end and side surface of the vane in FIG. 3.
Figure 5:
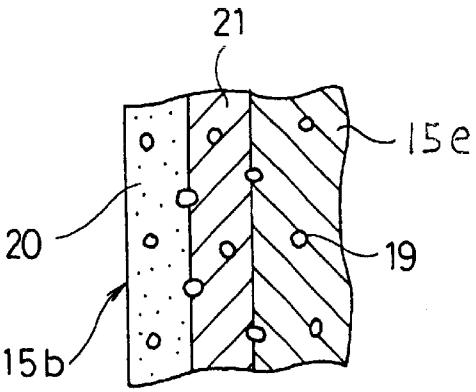
Figure 5:
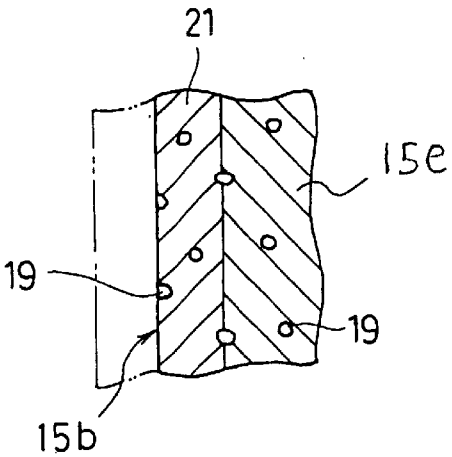

The finished base molded piece 15*e* was nitrided at temperature of 500 to 580° C. In this case, soft nitriding process is also possible. As shown in FIG. 4 and FIG. 5(*a*), FIG. 5(*b*), a nitrogen diffusion layer 21 is formed on the surface of the base molded piece 15*e* having pores 19, and an Fe—N compound layer 20 is formed on this nitrogen diffusion layer. The compound layer 20 at the vane side surface 15*b* is further ground, and the compound layer 20 at the side surface is removed. As a result, a nitrogen diffusion layer 21 of the side surface 15*b* is exposed, as shown in FIG. 5(*c*). The thickness of the nitrogen diffusion layer 21 is about 0.05 mm or more.

Such vane 15 contains Cr by 16.0 to 18.0%, and as compared with the conventional vane, the wear resistance of the compound layer 20 at the leading end 15*a* is enhanced, and the wear resistance and the agglutination wear resistance of the nitrogen diffusion layer 21 are extremely improved.

Besides, since the porosity of the base molded piece 15*e* is 15% or less, deep permeation of nitrogen gas into the inside of the vane 15 is prevented at the time of nitriding or soft nitriding process. Hence, the dimensional distortion is small, and decline of strength and brittleness by nitriding can be prevented. To the contrary, if the porosity exceeds 15%, for example, when the pores formed in the base molded piece are continuous pores, the vane strength declines and the vane becomes brittle, and operation in practical conditions is disabled. Further, when the porosity exceeds 15%, nitrogen gas diffuses in the entire base molded piece at the time of nitriding process, and a large distortion occurs in the vane 15, and the vane becomes unusable. It is therefore preferred that the porosity of the vane 15 be 15% or less. More preferably, when the porosity of the vane 15 is 10% or less, particularly excellent effects are obtained.

Besides, as the nitriding process undergoes in a temperature range of 500 to 580° C., the compound layer 20 and nitrogen diffusion layer 21 are formed stably. Hence, a stable wear resistance is exhibited. Moreover, since the thickness of the nitrogen diffusion layer 21 is 0.05 mm or more, the wear resistance of the nitrogen diffusion layer 21 is stabilized. If the nitriding temperature is lower than 500° C. or higher than 580° C., it is hard to form the compound layer 20 and nitrogen diffusion layer 21. More preferably, when the nitriding temperature is in a range of about 550 to 570° C., particularly excellent effects are obtained.

Figure 6:
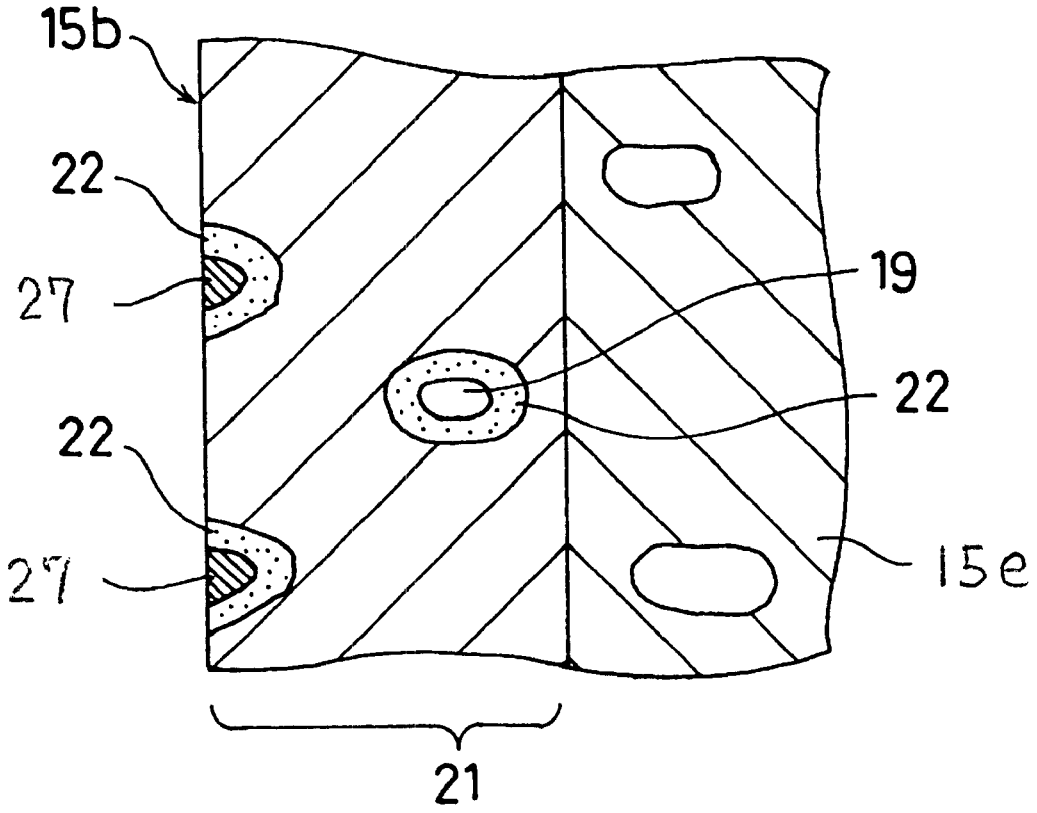
FIG. 6 is a magnified sectional view of the vane in FIG. 3.

Preferably, the pores 19 scatter about in the base molded piece 15*e*. In this case, as shown in FIG. 6, an Fe—N compound layer is formed as an in-pore compound layer 22 also in the inner wall of the pors 19 at the time of nitriding process. Accordingly, by this in-pore compound layer 22, refrigerating machine oil 27 is held in the pores 19. Therefore, the held refrigerating machine oil 27 is supplied on the sliding surface when the vane 15 slides, so that the wear resistance of the vane 15 is enhanced. If slight continuous pores are formed, the in-pore compound layer 22 plays as pore sealing means. Through this sealed in-pore compound layer 22, escape of applied pressure in the cylinder 7 or refrigerating machine oil 27 is prevented, and the refrigerating machine oil pressure is maintained. As a result, the wear resistance of the vane 15 is further enhanced.

Thus, the vane 15 has a sufficient strength. Further, the vane leading end 15*a* forming the compound layer 20 having an excellent wear resistance can prevent occurrence of agglutination wear on the outer circumference 13*a* of the roller 13 even in severe sliding conditions. The nitrogen diffusion layer 21 of the vane side surface 15*b* also has an excellent wear resistance. The roller 13 has an extremely excellent wear resistance owing to the components of Cr, Mo and P, and a further excellent quenching performance is realized by Ni. Moreover, since the cylinder 7 is made of eutectic graphite cast iron containing 15% or more of pearlite, it has an extremely excellent wear resistance.

Thus, in the rotary compressor of the exemplary embodiment, (a) if the added amount of the refrigerating machine oil 27 used for lubrication is slight, (b) if oil film is hardly formed on the sliding surface of the guide groove 14 and vane 15, and in particular when the HFC refrigerant not having lubricating property is used as the refrigerant, or (c) if the rotary compressor is used in severe sliding conditions such as boundary lubrication state close to metal contact hardly forming oil film on the leading end 15*a* of the vane 15 and outer circumference 13*a* of the roller, a compressor having a high long-term reliability is realized.

Exemplary Embodiment 2

A rotary compressor in exemplary embodiment 2 is composed as follows. A cylinder 7 is made of FC240 containing 95% or more of pearlite. A roller 13 is made of alloy cast iron containing 0.8% of Cr, 0.2% of Ni, 0.2% of Mo, and 0.04% of B, which is quenched and tempered.

Figure 7:
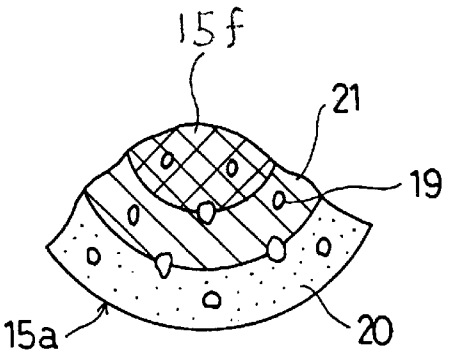
FIG. 7(*a*), FIG. 7(*a*), and FIG. 7(*c*) are sectional views of the leading end and side surface of the vane for composing the rotary compressor in an embodiment of the invention.
Figure 7:
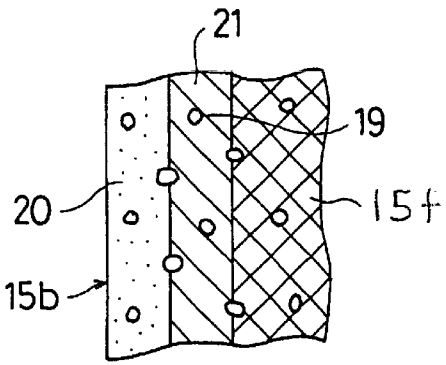
Figure 7:
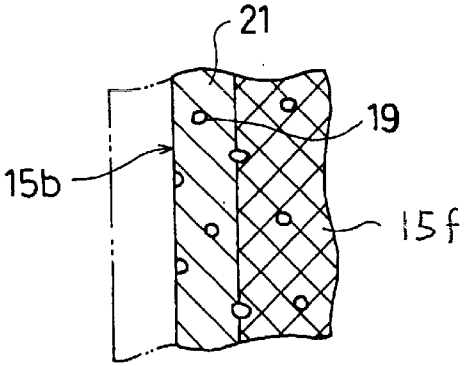

A base molded piece 15*f* of a vane 15 is made of SUS631 of precipitation hardenability containing 16.0 to 18.0% of Cr, 6.50 to 7.75% of Ni, and 0.09% or less of C, by molding and sintering in solid phase. This base molded piece 15*f* has a porosity of 15% or less. The base molded piece 15*f* is solidified, processed and precipitated. Thus, a mixed structure of martensite and precipitate is formed on the base molded piece 15*f*. The base molded piece 15*f* having such structure is ground, and a leading end 15*a* and a side surface 15*b* are finished. Then, by nitriding or soft nitriding, a compound layer 20 and a nitrogen diffusion layer 21 are formed on the base molded piece 15*f* as shown in FIG. 7(*a*) and FIG. 7(*a*). The compound layer 20 of the base side surface 15*b* contacting with the cylinder 7 is ground, and the nitrogen diffusion layer 21 of the side surface 15*b* is exposed as shown in FIG. 7(*c*). The compound 20 is left over at the leading end 15*a* of the vane 15 contacting with the outer circumference of the roller 13.

The other composition is same as that of exemplary embodiment 1.

The composition of this exemplary embodiment brings about the following benefits.

(a) If the sliding condition is severe on the sides of the guide groove 14 and vane 15 of the cylinder 7, or (b) if the sliding condition is close to metal contact state with little oil on the leading end 15*a* of the vane 15 and the outer circumference 13*a* of the roller 13, since the leading end 15*a* of the vane 15 has the compound layer 20 of excellent wear resistance, and agglutination wear of the outer circumference 13*a* of the roller 13 is prevented. Further, since the side surface 15*b* of the vane 15 has the nitrogen diffusion layer 21, wear is prevented. Since the roller 13 contains components of Cr, Mo and B. the roller 13 has an excellent wear resistance. Since the roller 13 containing Ni component, the roller has an excellent quenching performance. The cylinder 7 contains 95% or more of pearlite, and the wear resistance is excellent. Therefore, by the combination of the roller 13, vane 15 and cylinder 7, a rotary compressor having an excellent wear resistance is obtained. Hence, a rotary compressor having an excellent long-term reliability is realized.

Exemplary Embodiment 3

A rotary compressor in exemplary embodiment 3 is composed as follows. A roller 13 is made of alloy cast iron containing 0.8% of Cr, 0.2% of Ni, 0.2% of Mo, and 0.3% of P, which is quenched and tempered. A cylinder 7 is made of type A scaly graphite cast iron FC250 containing 90% or more of pearlite.

Figure 8:
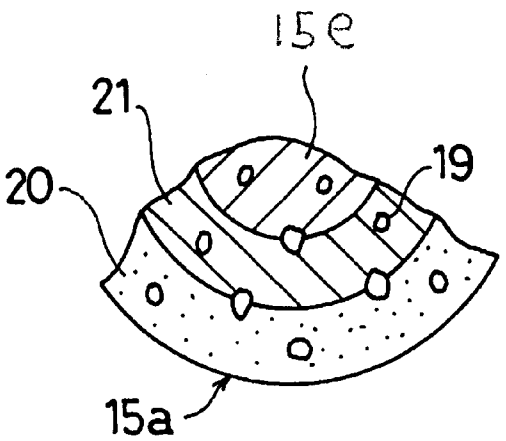
FIG. 8(*a*) and FIG. 8(*b*) are sectional views of the side surface of the vane for composing the rotary compressor in an embodiment of the invention.
Figure 8:
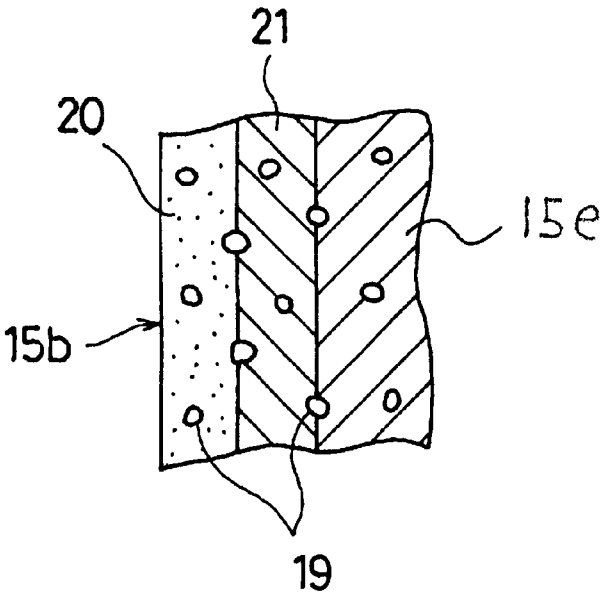

A base molded piece 15*e* of a vane 15 is made of martensitic stainless steel containing 0.95 to 1.2% of C and 16.0 to 18.0% of Cr, by molding and sintering in solid phase. This base molded piece 15*e* has a porosity of 15% or less. The base molded piece 15*e* is quenched and tempered, and a martensitic structure is formed. This base molded piece is ground, and a vane leading end 15*a* and a vane side surface 15*b* are finished. It is then nitrided at 500 to 570° C. Further, the leading end 15*a* and side surface 15*b* of the vane 15 are ground. The leading end 15*a* has a residual compound layer 20 as shown in FIG. 8(*a*). The surface roughness Ry of the leading end 15*a* is about 1 μm. The side surface 15*b* has a residual compound layer 20 as shown in FIG. 8(*b*).

The other composition is same as that of exemplary embodiment 1.

Such composition brings about the following benefits.

Since the surface roughness Ry of the leading end 15*a* of the vane 15 is about 1 μm, hertz stress is small even in the event of microscopic contact of the vane leading end 15*a* and roller 13. Hence, wear of vane and roller is prevented. Since the leading end 15*a* of the vane 15 has the residual compound layer 20, agglutination wear of vane and roller 13 is prevented. Also the side surface 15*b* has the residual compound layer 20, and the wear is extremely decreased not only on the vane side surface 15*b* but also the guide groove 14 of the cylinder 7. Moreover, refrigerating machine oil 27 is held in the pores 19 of the sliding surface of the leading end 15*a* and side surface 15*b* of the vane 15, so that the vane 15 has an extremely excellent wear resistance.

Therefore, by the combination of the roller 13, vane 15 and cylinder 7, the extent of wear is extremely decreased. Hence, a rotary compressor having an excellent long-term reliability is realized.

In this embodiment, the same base molded piece 15*f* as used in exemplary embodiment 2 may be used instead of the base molding piece 15*e*, and the same effects are obtained.

Exemplary Embodiment 4

A rotary compressor in exemplary embodiment 4 is composed as follows.

Figure 9:
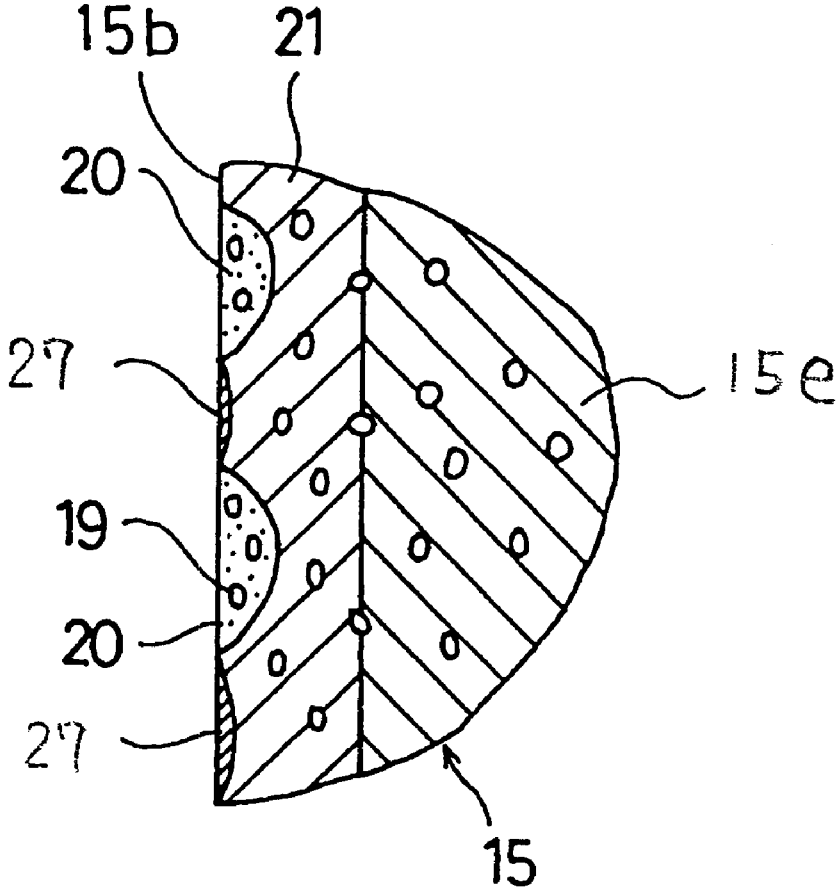
FIG. 9 is a sectional view of the side surface of the vane for composing the rotary compressor in an embodiment of the invention.

As shown in FIG. 9, by grinding near the boundary of the compound layer 20 and nitrogen diffusion layer 21, the side surface 15*b* of the vane 15 has a mixed structure of compound layer 20 and nitrogen diffusion layer 21.

The other composition is same as that of exemplary embodiment 3.

Thus, refrigerating machine oil 27 is held between a very rigid structure (compound layer 20) and a very rigid structure (nitrogen diffusion layer 21). Hence, the wear resistance is improved. As a result, a compressor having a high long-term reliability is realized.

In this embodiment, the same base molded piece 15*f* as used in exemplary embodiment 2 may be used instead of the base molding piece 15*e*, and the same effects are obtained.

Exemplary Embodiment 5

A rotary compressor in exemplary embodiment 5 is composed as follows.

Figure 10:
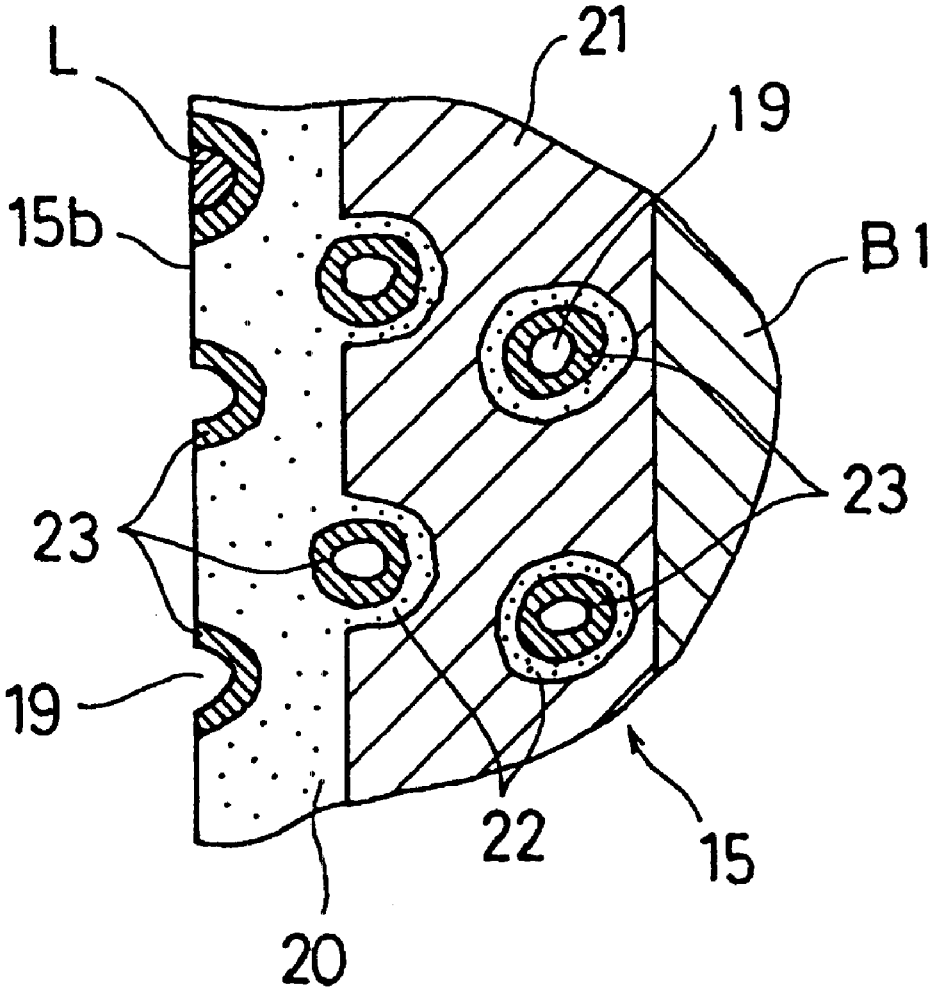
FIG. 10 is a sectional view of the side surface of the vane for composing the rotary compressor in an embodiment of the invention.

A base molded piece 15*e* of the vane 15 is made of martensitic stainless steel containing 0.95 to 1.2% of C and 16.0 to 18.0% of Cr, and is formed by molding and sintering in solid phase. This base molded piece 15*e* has a porosity of 15% or less. The base molded piece is quenched and tempered, and a martensitic structure is formed. Then the base molded piece is treated in steam. Thus, as shown in FIG. 10, an oxide film 23 formed of triion tetroxide is formed also in the pores 19 of the surface and inside.

Then, grinding same as in exemplary embodiment 3, the leading end 15*a* and side surface 15*b* are finished. By nitriding process at 560 to 570° C., compound layer 20, nitrogen diffusion layer 21, and in-pore compound layer 22 are formed. The base molded piece 15*e* is further ground. As a result, the leading end 15*a* has a residual compound layer 20, and the surface roughness Ry of the leading end 15*a* is about 1 μm. The side surface 15*b* has a residual compound layer 20.

The other composition is same as that of exemplary embodiment 3.

Such composition brings about the following benefits.

Generally, when the vane material has a film of high Cr component and chromium oxide, it is hard to form a nitride film by ordinary nitriding process alone. Accordingly, pretreatment for removing film of chromium oxide by hydrogen sulfide gas or nitrogen fluoride gas is needed. However, by treating the base molded piece with steam as in this exemplary embodiment, such pretreatment is not necessary. Or the pretreatment is simplified.

Besides, traces of in-pore compound layer 22 and oxide film 23 are left over in the pores 19 of the compound layer 20 and nitrogen diffusion layer 21 after nitriding process. As a result, the air tightness is improved. Further, since the triion tetroxide forming the oxide film 23 is porous, the refrigerating machine oil 27 holding capacity is large, and the wear resistance is enhanced. As a result, a compressor having a high long-term reliability is realized.

In this embodiment, the same base molded piece 15*f* as used in exemplary embodiment 2 may be used instead of the base molding piece 15*e*, and the same effects are obtained.

Thus, according to the composition of the embodiment, the vane having extremely excellent wear resistance, excellent mass producibility, and low cost is obtained. As a result, a compressor having a high long-term reliability is realized. Such vane produces particularly excellent effects in the compressor using substitute CFC refrigerant inferior in wear resistance such as HFC.

Moreover, since the vane is made of sintered iron, the vane can be formed by grinding process only. Therefore, the manufacturing process is notably saved, and the management of manufacturing process is curtailed. The vane of the invention is superior to the conventional sintered iron merely forming pores in the aspects of strength, dimensional distortion, and mass producibility.

Further, Fe—N compound layer is formed also in the pores, and the refrigerating machine oil can be held, so that the wear resistance is extremely improved.

Thus, according to the construction of the invention, the wear resistance of the vane is notably improved, and a rotary compressor having an extremely high long-term reliability is realized.

What is claimed is:

1. A rotary compressor comprising:

(a) a cylinder having an inner space and a groove, said groove penetrating through an outside and an inner space of said cylinder, (b) a roller sliding along the inner surface of the inner space of said cylinder, (c) a vane inserted in said groove, said vane sliding in and out in said groove while sliding on said roller, and (d) a refrigerant, wherein said vane includes sintered stainless steel, a nitrogen diffusion layer disposed on the sintered stainless steel, and a compound layer of iron and nitrogen disposed on the nitrogen diffusion layer, and the sintered stainless steel has a plurality of fine pores formed by sintering of the powder material, and the plurality of fine pores have a porosity in a range of more than 0% to 15% or less.

2. The rotary compressor of claim 1, wherein at least one of said plurality of fine pores is disposed to the surface of said vane, said nitrogen diffusion layer and said compound layer is disposed on said surface of said at least one of said plurality of fine pores, and said at least one fine pores which places on the surface of said vane is exposed to the surface of said vane.

3. The rotary compressor of claim 2, wherein said refrigerant includes a refrigerating machine oil, and said oil placed in said at least one fine pores which places on the surface of said vane.

4. A rotary compressor comprising:

(a) a cylinder having an inner space and a groove, said groove penetrating through an outside and an inner space of said cylinder, (b) a roller sliding along the inner surface of the inner space of said cylinder, (c) a vane inserted in said groove, said vane sliding in and out in said groove while sliding on said roller, and (d) a refrigerant, wherein said vane includes stainless steel of martensitic structure, a nitrogen diffusion layer disposed on the surface of the stainless steel, and a compound layer of iron and nitrogen disposed on the surface of the nitrogen diffusion layer, said stainless steel has one chemical composition of either (i) a chemical composition of iron, 9 to 27% of chromium, and 0.4% or more of carbon, or (ii) a chemical composition of iron, 9 to 27% of chromium, 4 to 8% of nickel, and 0.2% or less of carbon, and said stainless steel has a plurality of fine pores formed by sintering of powder material having a hardening property, and the plurality of fine pores have a porosity in a range of more than 0% to 15% or less.

5. The rotary compressor of claim 4, wherein said martensitic structure is formed of a base molded piece, said base molded piece is formed by sintering of said powder material, and said base molded piece is formed by at least one of solid phase sintering and liquid phase sintering.

6. The rotary compressor of claim 4, wherein said vane has a vane leading end sliding on the roller, said vane leading end has a surface of the compound layer, and the surface of said compound layer slides on the surface of said roller.

7. The rotary compressor of claim 4, wherein said vane has a vane leading end sliding on the roller, said vane leading end has a surface of the compound layer having a surface roughness of 3 $\mu$m or less exposed by grinding process, and the surface of said compound layer slides on the surface of said roller.

8. The rotary compressor of claim 4, wherein said nitrogen diffusion layer and compound layer are formed by at least one of gas nitriding and gas soft nitriding process.

9. The rotary compressor of claim 4, wherein said nitrogen diffusion layer has a thickness of 0.05 mm or more.

10. The rotary compressor of claim 4, further comprising refrigerating machine oil, wherein said refrigerant is hydrofluorocarbon, and said refrigerating machine oil contains ester oil.

11. The rotary compressor of claim 4, wherein said refrigerant contains difluoromethane.

12. The rotary compressor of claim 4, further comprising a compound layer of iron and nitrogen formed in the plurality of fine pores.

13. The rotary compressor of claim 4, further comprising refrigerating machine oil, wherein said refrigerating machine oil may be adhered to the plurality of fine pores.

14. The rotary compressor of claim 4, wherein a surface of said vane including said compound layer and said nitrogen diffusion layer has at least one of said plurality of fine pores, said at least one fine pores which places on the surface of said vane is exposed to the surface of said vane, said refrigerant includes a refrigerating machine oil, and said oil placed in said at least one fine pores which places on the surface of said vane.

15. A rotary compressor comprising:

(a) a cylinder having an inner space and a groove, said groove penetrating through the outside and inner space of said cylinder, (b) a roller sliding along the inner surface of the inner space of said cylinder, (c) a vane inserted in said groove, said vane sliding in and out in said groove while sliding on said roller, and (d) a refrigerant, wherein said vane includes stainless steel having a martensitic structure, a nitrogen diffusion layer disposed on the surface of the stainless steel, and a compound layer of iron and nitrogen disposed on the surface of the nitrogen diffusion layer, said stainless steel has a chemical composition of iron, 9 to 27% of chromium, and 0.4% or more of carbon, and said stainless steel has a plurality of fine pores formed by sintering of the powder material having quenching hardenability, and the plurality of fine pores have a porosity in a range of more than 0% to 15% or less.

16. The rotary compressor of claim 15, wherein said cylinder has a nearly cylindrical shape, said groove is formed in the radial direction of the cylinder, the inner space of the cylinder has a circular cross section, said space has a suction part and a discharge part, the outer circumference of the roller has a circular cross section, the outer circumference of the roller rotates in the inner space while sliding on the inner circumference of the inner space, and the leading end of the vane slides on the outer circumference of the roller and the vane slides in and out of the groove, and the vane also partitions the inner space of the cylinder into the suction part and the discharge part.

17. The rotary compressor of claim 15, wherein said powder material has a quenching hardenability, said martensitic structure is formed by quenching process and tempering process of a base molded piece, said base molded piece is formed by sintering of said powder material, and said nitrogen diffusion layer and compound layer are formed by nitriding process of the base molded piece having martensitic structure.

18. The rotary compressor of claim 15, wherein said stainless steel contains at least one selected from the group consisting of SUS440A, SUS440B, SUS440C, SKD1, and SKD11.

19. The rotary compressor of claim 15, wherein a surface of said vane including said compound layer and said nitrogen diffusion layer has at least one of said plurality of fine pores, said at least one fine pores which places on the surface of said vane is exposed to the surface of said vane, said refrigerant includes a refrigerating machine oil, and said oil placed in said at least one fine pores which places on the surface of said vane.

20. A rotary compressor comprising:

(a) a cylinder having an inner space and a groove,
said groove penetrating through the outside and inner space of said cylinder, (b) a roller sliding along the inner surface of the inner space of said cylinder, (c) a vane inserted in said groove,
said vane sliding in and out in said groove while sliding on said roller, and (d) a refrigerant,
wherein said vane includes stainless steel having a martensitic structure, a nitrogen diffusion layer disposed on the surface of the stainless steel, and a compound layer of iron and nitrogen disposed on the surface of the nitrogen diffusion layer,
the stainless steel has a chemical composition of iron, 9 to 27% of chromium, 4 to 8% of nickel; and 0.2% or less of carbon, and
the stainless steel has a plurality of fine pores formed by sintering of the powder material having precipitation hardenability, and the plurality of fine pores have a porosity in a range of more than 0% to 15% or less.

21. The rotary compressor of claim 20, wherein said cylinder has a nearly cylindrical shape, said groove is formed in the radial. direction of the cylinder, the inner space of the cylinder has a circular cross section, said space has a suction part and a discharge part, an outer circumference of the roller has a circular cross section, the outer circumference of the roller rotates in the inner space while sliding on the inner circumference of the inner space, and a leading end of the vane slides on the outer circumference of the roller and the vane slides in and out of the groove, and the vane also partitions the inner space of the cylinder into the suction part and the discharge part.

22. The rotary compressor of claim 20, wherein said powder material has a precipitation hardenability, said martensitic structure is formed by heat treatment of a base molded piece, said base molded piece is formed by sintering of said powder material, and said nitrogen diffusion layer and compound layer are formed by nitriding process of the base molded piece having martensitic structure.

23. The rotary compressor of claim 20, wherein said stainless steel contains at least one of SUS630 and SUS631.

24. The rotary compressor of claim 20, wherein a surface of said vane including said compound layer and said nitrogen diffusion layer has at least one of said plurality of fine pores, said at least one fine pores which places on the surface of said vane is exposed to the surface of said vane, said refrigerant includes a refrigerating machine oil, and said oil placed in said at least one fine pores which places on the surface of said vane.

25. A rotary compressor comprising:

(a) a cylinder having an inner space and a groove,
said groove penetrating through an outside and an inner space of said cylinder, (b) a roller sliding along the inner surface of the inner space of said cylinder, (c) a vane inserted in said groove,
said vane sliding in and out in said groove while sliding on said roller, and (d) a refrigerant,
wherein said vane includes stainless steel of martensitic structure, a nitrogen diffusion layer disposed on the surface of the stainless steel, and a compound layer of iron and nitrogen disposed on the surface of the nitrogen diffusion layer,
said stainless steel has one chemical composition of either
(i) a chemical composition of iron, 9 to 27% of chromium, and 0.4% or more of carbon, or
(ii) a chemical composition of iron, 9 to 27% of chromium, 4 to 8% of nickel, and 0.2% or less of carbon, and
said stainless steel has a plurality of fine pores formed by sintering of powder material having a hardening property, and the plurality of fine pores have a porosity in a range of more than 0% to 15% or less, and wherein said vane has a vane side surface sliding in the groove, said vane side surface has a surface of the nitrogen diffuse layer exposed by grinding process, and said nitrogen diffusion layer of the vane side surface slides on the inner surface of the groove.

26. A rotary compressor comprising:

(a) a cylinder having an inner space and a groove, said groove penetrating through an outside and an inner space of said cylinder, (b) a roller sliding along the inner surface of the inner space of said cylinder, (c) a vane inserted in said groove, said vane sliding in and out in said groove while sliding on said roller, and (d) a refrigerant, wherein said vane includes stainless steel of martensitic structure, a nitrogen diffusion layer disposed on the surface of the stainless steel, and a compound layer of iron and nitrogen disposed on the surface of the nitrogen diffusion layer, said stainless steel has one chemical composition of either (i) a chemical composition of iron, 9 to 27% of chromium, and 0.4% or more of carbon, or (ii) a chemical composition of iron, 9 to 27% of chromium, 4 to 8% of nickel, and 0.2% or less of carbon, and said stainless steel has a plurality of fine pores formed by sintering of powder material having a hardening property, and the plurality of fine pores have a porosity in a range of more than 0% to 15% or less, and wherein said vane has a vane side surface sliding in the groove, said vane side surface has both surfaces of the nitrogen diffusion layer and compound layer exposed by grinding process, and both the nitrogen diffusion layer and compound layer of the vane side surface slide on the inner surface of the groove.

27. A rotary compressor comprising:

(a) a cylinder having an inner space and a groove, said groove penetrating through an outside and an inner space of said cylinder, (b) a roller sliding along the inner surface of the inner space of said cylinder, (c) a vane inserted in said groove, said vane sliding in and out in said groove while sliding on said roller, and (d) a refrigerant, wherein said vane includes stainless steel of martensitic structure, a nitrogen diffusion layer disposed on the surface of the stainless steel, and a compound layer of iron and nitrogen disposed on the surface of the nitrogen diffusion layer, said stainless steel has one chemical composition of either (i) a chemical composition of iron, 9 to 27% of chromium, and 0.4% or more of carbon, or (ii) a chemical composition of iron, 9 to 27% of chromium, 4 to 8% of nickel, and 0.2% or less of carbon, and said stainless steel has a plurality of fine pores formed by sintering of powder material having a hardening property, and the plurality of fine pores have a porosity in a range of more than 0% to 15% or less, and wherein said vane has a vane side surface sliding in the groove, said vane side surface has a surface of the compound layer exposed by grinding process, at least one pore of the plurality of fine pores is exposed on the surface of the compound layer, and the compound layer of the vane side surface slides on the inner surface of the groove.

28. A rotary compressor comprising:

(a) a cylinder having an inner space and a groove, said groove penetrating through an outside and an inner space of said cylinder, (b) a roller sliding along the inner surface of the inner space of said cylinder, (c) a vane inserted in said groove, said vane sliding in and out in said groove while sliding on said roller, and (d) a refrigerant, wherein said vane includes stainless steel of martensitic structure, a nitrogen diffusion layer disposed on the surface of the stainless steel, and a compound layer of iron and nitrogen disposed on the surface of the nitrogen diffusion layer, said stainless steel has one chemical composition of either (i) a chemical composition of iron, 9 to 27% of chromium, and 0.4% or more of carbon, or (ii) a chemical composition of iron, 9 to 27% of chromium, 4 to 8% of nickel, and 0.2% or less of carbon, and said stainless steel has a plurality of fine pores formed by sintering of powder material having a hardening property, and the plurality of fine pores have a porosity in a range of more than 0% to 15% or less, wherein said pore of the vane has an oxide film formed by steam treatment, and said nitrogen diffusion layer is disposed on said oxide film.

29. A rotary compressor comprising (a) a cylinder having an inner space and a groove, said groove penetrating through an outside and an inner space of said cylinder, (b) a roller sliding along the inner surface of the inner space of said cylinder, (c) a vane inserted in said groove, said vane sliding in and out in said groove while sliding on said roller, and (d) a refrigerant, wherein said vane includes stainless steel of martensitic structure, a nitrogen diffusion layer disposed on the surface of the stainless steel, and a compound layer of iron and nitrogen disposed on the surface of the nitrogen diffusion layer, said stainless steel has one chemical composition of either (i) a chemical composition of iron, 9 to 27% of chromium, and 0.4% or more of carbon, or (ii) a chemical composition of iron, 9 to 27% of chromium, 4 to 8% of nickel, and 0.2% or less of carbon, and said stainless steel has a plurality of fine pores formed by sintering of powder material having a hardening property, and the plurality of fine pores have a porosity in a range of more than 0% to 15% or less, wherein said roller is made of cast alloy containing iron, 0.5 to 1.0% of chromium, 0.2 to 0.4% of molybdenum, and 0.1 to 0.4% of phosphorus.

30. A rotary compressor comprising:

(a) a cylinder having an inner space and a groove,
said groove penetrating through an outside and an inner space of said cylinder, (b) a roller sliding along the inner surface of the inner space of said cylinder, (c) a vane inserted in said groove,
said vane sliding in and out in said groove while sliding on said roller, and (d) a refrigerant,
wherein said vane includes stainless steel of martensitic structure, a nitrogen diffusion layer disposed on the surface of the stainless steel, and a compound layer of iron and nitrogen disposed on the surface of the nitrogen diffusion layer,
said stainless steel has one chemical composition of either
(i) a chemical composition of iron, 9 to 27% of chromium, and 0.4% or more of carbon, or
(ii) a chemical composition of iron, 9 to 27% of chromium, 4 to 8% of nickel, and 0.2% or less of carbon, and
said stainless steel has a plurality of fine pores formed by sintering of powder material having a hardening property, and the plurality of fine pores have a porosity in a range of more than 0% to 15% or less,
wherein said roller is made of cast alloy containing iron, 0.5 to 1.0% of chromium, 0.2 to 0.4% of molybdenum, and 0.02 to 0.1% of boron.

31. A rotary compressor comprising:

(a) a cylinder having an inner space and a groove,
said groove penetrating through an outside and an inner space of said cylinder, (b) a roller sliding along the inner surface of the inner space of said cylinder, (c) a vane inserted in said groove,
said vane sliding in and out in said groove while sliding on said roller, and (d) a refrigerant,
wherein said vane includes sintered stainless steel, a nitrogen diffusion layer disposed on the surface of the stainless steel, and a compound layer of iron and nitrogen disposed on the surface of the nitrogen diffusion layer,
said stainless steel has a plurality of fine pores formed by sintering of powder material, and the plurality of fine pores have a porosity in a range of more than 0% to 15% or less,
said vane has a vane side surface sliding in the groove,
said vane side surface has a surface of the nitrogen diffuse layer exposed by grinding process, and
said nitrogen diffusion layer of the vane side surface slides on the inner surface of the groove.

32. A rotary compressor comprising:

(a) a cylinder having an inner space and a groove,
said groove penetrating through an outside and an inner space of said cylinder, (b) a roller sliding along the inner surface of the inner space of said cylinder, (c) a vane inserted in said groove,
said vane sliding in and out in said groove while sliding on said roller, and (d) a refrigerant,
wherein said vane includes sintered stainless steel, a nitrogen diffusion layer disposed on the surface of the stainless steel, and a compound layer of iron and nitrogen disposed on the surface of the nitrogen diffusion layer,
said stainless steel has a plurality of fine pores formed by sintering of powder material, and the plurality of fine pores have a porosity in a range of more than 0% to 15% or less,
said vane has a vane side surface sliding in the groove,
said vane side surface has both surface of the nitrogen diffuse layer and compound layer exposed by grinding process, and
both said nitrogen diffusion layer and compound layer of the vane side surface slides on the inner surface of the groove.

33. A manufacturing method of rotary compressor comprising the steps of:

(a) preparing a cylinder,
(b) preparing a roller,
(c) preparing a vane,
(d) presenting a refrigerant, and
(e) assembling the cylinder, roller, vane, and refrigerant,
wherein said step of preparing the vane includes the steps of:
(i) molding a stainless steel powder material into a specified shape, and forming a molded piece,
(ii) baking said molded piece and forming a base molded piece having fine pores,
said fine pores having a porosity in a range of more than 0% to 15% or less,
(iii) heating said base molded piece, and forming a base molded piece having martensitic structure, and
(iv) nitriding said base molded piece having the martensitic structure and fine pores, and placing a nitrogen diffusion layer and an iron-nitrogen compound layer on the surface of the base molded piece,
said nitrogen diffusion layer being formed on said base molded piece, and said compound layer being formed on said nitrogen diffusion layer.

34. The manufacturing method of rotary compressor of claim 33,
wherein said step of baking the molded piece includes at least one baking step of solid phase baking and liquid phase baking.

35. The manufacturing method of rotary compressor of claim 33,
wherein said step of preparing the vane further includes a step of:
(v) cutting the side of the vane, and exposing the fine pores formed in the compound layer of the side of the vane, and
the compound layer having fine pores at the side of the vane slides on the groove formed in the cylinder.

36. The manufacturing method of rotary compressor of claim 33,
wherein the leading end of the vane has the compound layer, and
said vane leading end having the compound layer slides on the roller.

37. The manufacturing method of rotary compressor of claim 33, wherein said step of preparing the vane further includes a step of:

(v) cutting a leading end of the vane, and exposing the surface of the compound layer having the surface roughness Ry of 3 μm or less, and the compound layer having the surface roughness Ry of 3 μm or less at the leading end of the vane slides on the roller.

38. The manufacturing method of rotary compressor of claim 33, wherein said step (iv) of nitriding the base molded piece includes at least one of gas nitriding process and gas soft nitriding process.

39. The manufacturing method of rotary compressor of claim 33, wherein said step (iv) includes a step of forming the nitrogen diffusion layer of thickness of 0.05 mm or more by nitriding the base molded piece in a temperature range of 500 to 580° C.

40. The manufacturing method of rotary compressor of claim 33, wherein said step of preparing the roller further includes a step of forming a cast alloy in a chemical composition containing iron, 0.5 to 1.0% of chromium, 0.2 to 0.4% of molybdenum, and 0.1 to 0.4% of phosphorus.

41. The manufacturing method of rotary compressor of claim 33, wherein said step of preparing the roller further includes a step of forming a cast alloy in a chemical composition containing iron, 0.5 to 1.0% of chromium, 0.2 to 0.4% of molybdenum, and 0.02 to 0.1% of boron.

42. The manufacturing method of rotary compressor of claim 33, wherein said rotary compressor further comprises refrigerating machine oil, said refrigerant contains hydrofluorocarbon, and said refrigerating machine oil contains ester oil.

43. The manufacturing method of rotary compressor of claim 33, wherein said refrigerant contains difluoromethane.

44. The manufacturing method of rotary compressor of claim 33, wherein said fine pores includes a further compound layer of iron and nitrogen formed in said fine pores.

45. The manufacturing method of rotary compressor of claim 33, wherein said rotary compressor further comprises refrigerating machine oil, and said refrigerating machine oil may be adhered to the fine pores.

46. The manufacturing method of rotary compressor of claim 33, wherein a surface of said vane including said compound layer and said nitrogen diffusion layer has at least one of said plurality of fine pores, said at least one fine pores which places on the surface of said vane is exposed to the surface of said vane, said refrigerant includes a refrigerating machine oil, and said oil placed in said at least one fine pores which places on the surface of said vane.

47. The manufacturing method of rotary compressor of claim 33, wherein said cylinder has an inner space and a groove, said groove penetrates through the outside and inner space of said cylinder, said roller slides along the inner surface of the inner space of said cylinder, said vane is inserted in said groove, and said vane slides in and out in said groove while sliding on said roller.

48. The manufacturing method of rotary compressor of claim 47, wherein said cylinder has a nearly cylindrical shape, said groove is formed in the radial direction of the cylinder, the inner space of the cylinder has a circular cross section, said space has a suction part and a discharge part, the outer circumference of the roller has a circular cross. section, the outer circumference of the roller rotates in the inner space while sliding on the inner circumference of the inner space, and the leading end of the vane slides on the outer circumference of the roller and the vane slides in and out of the groove, and the vane also partitions the inner space of the cylinder into the suction part and the discharge part.

49. The manufacturing method of rotary compressor of claim 33, wherein said powder material has a chemical composition containing iron, 9 to 27% of chromium, and 0.4% or more of carbon, said powder material has a quenching hardenability, and said step of heating the base molded piece includes quenching process and tempering process of the base molded piece.

50. The manufacturing method of rotary compressor of claim 49, wherein said stainless steel powder material contains at least one selected from the group consisting of SUS440A, SUS440B, SUS440C, SKD1, and SKD11.

51. The manufacturing method of rotary compressor of claim 33, wherein said powder material has a chemical composition containing iron, 9 to 27% of chromium, 4 to 8% of nickel, and 0.2% or less of carbon, and said powder material has precipitation hardenability.

52. The manufacturing method of rotary compressor of claim 51, wherein said stainless steel powder material contains at least one selected from the group consisting of SUS630 and SUS631.

53. A manufacturing method of rotary compressor comprising the steps of:

(a) preparing a cylinder, (b) preparing a roller, (c) preparing a vane, (d) presenting a refrigerant, and (e) assembling the cylinder, roller, vane, and refrigerant, wherein said step of preparing the vane includes the steps of:

(i) molding a stainless steel powder material into a specified shape, and forming a molded piece, (ii) baking said molded piece and forming a base molded piece having fine pores, said fine pores having a porosity in a range of more than 0% to 15% or less, (iii) heating said base molded piece, and forming a base molded piece having martensitic structure, and (iv) nitriding said base molded piece having the martensitic structure and fine pores, and placing a nitrogen diffusion layer and an iron-nitrogen compound layer on the surface of the base molded piece, said nitrogen diffusion layer being formed on said base molded piece, and said compound layer being formed on said nitrogen diffusion layer, wherein said step of preparing the vane further includes a step of:

(v) cutting the side of the vane, removing the compound layer disposed on the side of the vane, and exposing the nitrogen diffusion layer, and the nitrogen diffusion layer at the side of the vane slides on the groove formed in the cylinder.

54. A manufacturing method of rotary compressor comprising the steps of:

(a) preparing a cylinder, (b) preparing a roller, (c) preparing a vane, (d) presenting a refrigerant, and (e) assembling the cylinder, roller, vane, and refrigerant, wherein said step of preparing the vane includes the steps of:

(i) molding a stainless steel powder material into a specified shape, and forming a molded piece, (ii) baking said molded, piece and forming a base molded piece having fine pores, said fine pores having a porosity in a range of more than 0% to 15% or less, (iii) heating said base molded piece, and forming a base molded piece having martensitic structure, and (iv) nitriding said base molded piece having the martensitic structure and fine pores, and placing a nitrogen diffusion layer and an iron-nitrogen compound layer on the surface of the base molded piece, said nitrogen diffusion layer being formed on said base molded piece, and said compound layer being formed on said nitrogen diffusion layer, wherein said step of preparing the vane further includes a step of:

(v) cutting the side of the vane, and exposing both a part of the compound layer and a part of the nitrogen diffusion layer disposed at the side of the vane, and a surface having both the part of the compound layer and the part of the nitrogen diffusion layer at the side of the vane slides on the groove formed in the cylinder.

55. A manufacturing method of rotary compressor comprising the steps of:

(a) preparing a cylinder, (b) preparing a roller, (c) preparing a vane, (d) presenting a refrigerant, and (e) assembling the cylinder, roller, vane, and refrigerant; wherein said step of preparing the vane includes the steps of:

(i) molding a stainless steel powder material into a specified shape, and forming a molded piece, (ii) baking said molded piece and forming a base molded piece having fine pores, said fine pores having a porosity in a range of more than 0% to 15% or less, (iii) heating said base molded piece, and forming a base molded piece having martensitic structure, (iv) treating the surface of the base molded piece having fine pores with steam, and forming an oxide film in the fine pores, (v) nitriding said base molded piece having the martensitic structure and fine pores, and placing a nitrogen diffusion layer and an iron-nitrogen compound layer on the surface of the base molded piece, said nitrogen diffusion layer being formed on said base molded piece and said oxide film, and said compound layer being formed on said nitrogen diffusion layer.

* * * * *